United States Patent [19]

Billingsley et al.

[11] Patent Number: 4,566,424

[45] Date of Patent: Jan. 28, 1986

[54] FLEXIBLE COUPLING FOR CARBURETORS

[75] Inventors: Henry C. Billingsley, Waukegan; Chester G. DuBois, Zion, both of Ill.

[73] Assignee: Outboard Marine Corporation, Waukegan, Ill.

[21] Appl. No.: 635,568

[22] Filed: Jul. 30, 1984

[51] Int. Cl.[4] ..... F02B 13/00

[52] U.S. Cl. ..... 123/583; 464/101; 464/77

[58] Field of Search ..... 123/442, 583, 59 PC; 464/101, 77

[56] References Cited

U.S. PATENT DOCUMENTS

| | | | |
|---|---|---|---|
| 2,246,750 | 6/1941 | Murphy | 464/101 |
| 2,580,000 | 12/1951 | Batcher | 464/101 |
| 2,591,769 | 4/1952 | Beechler | 464/101 |
| 2,724,251 | 11/1955 | Weaver | 464/101 |
| 2,903,867 | 9/1959 | Moody | 464/101 |
| 3,340,704 | 9/1967 | Seckerson | 464/101 |
| 4,261,304 | 4/1981 | Yamada | 123/583 |

FOREIGN PATENT DOCUMENTS

| | | | |
|---|---|---|---|
| 570282 | 2/1933 | Fed. Rep. of Germany | 464/101 |
| 2150166 | 4/1972 | Fed. Rep. of Germany | 123/59 PC |

*Primary Examiner*—E. Rollins Cross

*Attorney, Agent, or Firm*—Michael, Best & Friedrich

[57] ABSTRACT

A fuel supply assembly including carburetors with separate throttle shafts in general axially alignment, and a U-shaped coupling for flexibly connecting the carburetor throttle shafts. The coupling includes a bight connected to a pair of legs each having a free end including a U-shaped member having a pair of arms with apertures for receiving one of the carburetor throttle shafts, each of the U-shaped members also including an arcuate bight having arcuate side portions separated by a centrally located slot communicating with the arm apertures, and also including a nut and bolt arrangement extending through the U-shaped member transverse to the throttle shaft for squeezing the arcuate side portions to reduce the opening size of the slot and arm apertures, whereby the pair of arms in each of the U-shaped members engages a separate one of the carburetor throttle shafts so that the pair of carburetor throttle shafts are flexibly coupled for common rotation.

26 Claims, 3 Drawing Figures

FLEXIBLE COUPLING FOR CARBURETORS

BACKGROUND AND SUMMARY OF THE INVENTION

This invention relates to a fuel supply assembly including a pair of carburetors with separate throttle shafts having axes of rotation in general alignment, and a device for flexibly coupling the carburetor throttle shafts for common rotation.

Attention is directed to the following U.S. patents:

Murphy, U.S. Pat. No. 2,246,750, issued June 24, 1941;

Batcher, U.S. Pat. No. 2,580,000, issued Dec. 25, 1951;

Beechler, U.S. Pat. No. 2,591,769, issued Apr. 8, 1952;

Weaver, U.S. Pat. No. 2,724,251, issued Nov. 22, 1955;

Moody, U.S. Pat. No. 2,903,867, issued Sept. 15, 1959; and

Seckerson, U.S. Pat. No. 3,346,704 issued Sept. 12, 1967.

Attention is also directed to German Pat. No. 570,282 and to Great Britain Pat. No. 517,635.

Attention is also directed to an article concerning couplings contained in the June 30, 1983 issue of *MACHINE DESIGN* appearing at pages 58–64.

The invention provides a fuel supply assembly including two carburetors having a pair of separate carburetor throttle shafts which may be axially offset or out of alignment, and a generally U-shaped flexible coupling for connecting the pair of separate carburetor throttle shafts. The coupling includes a bight connected to a pair of legs each having a free end including a generally U-shaped member having a pair of arms with apertures for receiving one of the carburetor throttle shafts, each of the U-shaped members also including an arcuate bight having arcuate side portions separated by a centrally located slot communicating with the arm apertures, and also including clamping means for squeezing together the arcuate side portions of the arcuate bight to reduce the opening size of the slot and arm apertures, whereby the pair or arms of each of the U-shaped members engages a separate one of the carburetor throttle shafts so that the pair of carburetor throttle shafts are flexible coupled for common rotation.

The invention also provides a generally U-shaped flexible coupling for connecting a pair of separate carburetor throttle shafts which may be axially offset or out of alignment, the coupling having a structure substantially the same as the coupling included within the fuel supply assembly discussed above. Also, the invention provides a generally U-shaped flexible coupling for flexibly connecting a pair of rotatable members having generally aligned axes of rotation.

In one embodiment, the clamping means for each of the U-shaped members includes a bolt extending through the U-shaped member, generally transverse to the carburetor throttle shaft, and adjacent to the arcuate side portions of the arcuate bight, the bolt including, at one end thereof, a head, and, at the other end thereof, a threaded portion, with the clamping means also including a nut which threadingly engages the threaded portion to squeeze together the arcuate side portions to reduce the opening size of the slot and arm apertures. Each of the U-shaped members preferably includes locking means for locking the nut against rotation when the bolt is threadingly engaged and tightened within the nut.

Also in accordance with an embodiment of the invention, one of the carburetor throttle shafts includes an end with a flat which extends through the aperture in one of a pair of arms of one of the U-shaped members, and the one arm includes a matching flat extending into the aperture, thereby preventing rotation or displacement of the one throttle shaft relative to the coupling, and controlling the arc which the coupling travels through as the one throttle shaft rotates. The carburetor throttle shafts each include a throttle valve mounted thereon, and the other one of the U-shaped members includes a pair of arms with generally circular apertures so that the coupling can be used to synchronize the rotational position of the throttle valves mounted on the throttle shafts.

Also in accordance with an embodiment of the invention, the U-shaped coupling is preferably installed under compression with the U-shaped members biased toward each other so that if there is axial displacement and separation of the carburetor throttle shafts, the coupling can expand so the throttle shafts remain fully engaged within the U-shaped members of the coupling.

One of the principal features of this invention is the provision of a fuel supply assembly including carburetors with separate throttle shafts which may be axially offset or out of alignment, and a generally U-shaped coupling for flexibly coupling the throttle shafts for common rotation.

Another of the principal features of the invention is the provision of such a fuel supply assembly wherein the coupling is relatively inexpensive and includes a pair of legs each having a free end including a U-shaped member having a pair of arms with apertures for receiving one of the carburetor throttle shafts, and wherein one of the throttle shafts includes a flat which corresponds to a matching flat in the arm aperture of one of the U-shaped members, thereby controlling the arc which the coupling travels through as the throttle shafts rotate.

Another of the principal features of the invention is the provision of such a fuel supply assembly wherein the coupling is installed under compression with the U-shaped members biased toward each other so that if there is axial displacement and separation of the throttle shafts, the coupling can expand so that the throttle shafts remain fully engaged within the U-shaped members of the coupling.

Other features and advantages of embodiments of the invention will become apparent upon review of the following drawings, the detailed description and appended claims.

Figure 3:
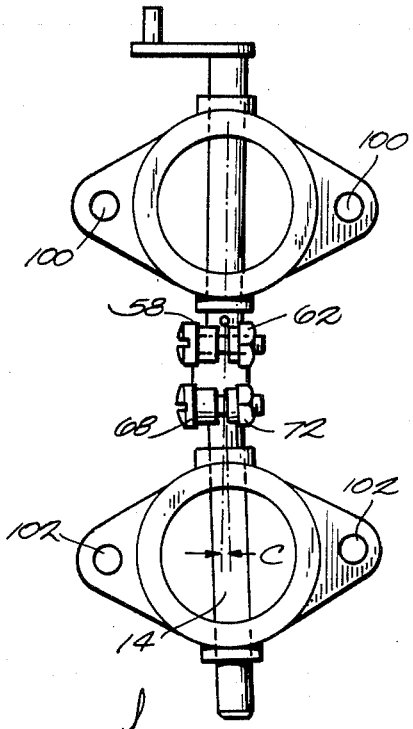
FIG. 3 is a top view taken along line 3—3 in FIG. 2.

Before explaining at least one embodiment of the invention in detail, it is to be understood that the invention is not limited in its application to details of construction and the arrangements of the components set forth in the following description or illustrated in the drawings. The invention is capable of other embodiments and being practiced or carried out in various ways. Also, it is to be understood that the phraseology and terminology employed herein is for the purpose of description and should not be regarded as limiting.

DESCRIPTION OF THE PREFERRED EMBODIMENT

Figure 2:
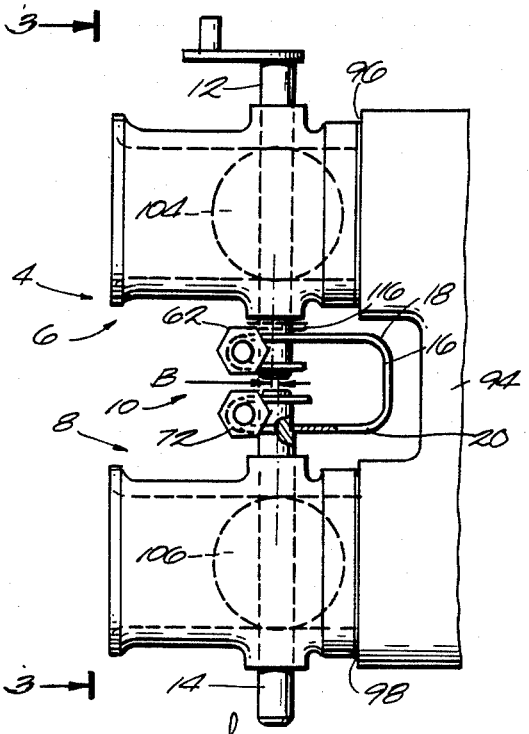
FIG. 2 is a side view of the fuel supply assembly including a pair of carburetors having throttle shafts coupled by the flexible coupling, shown in FIG. 1.
Figure 1:
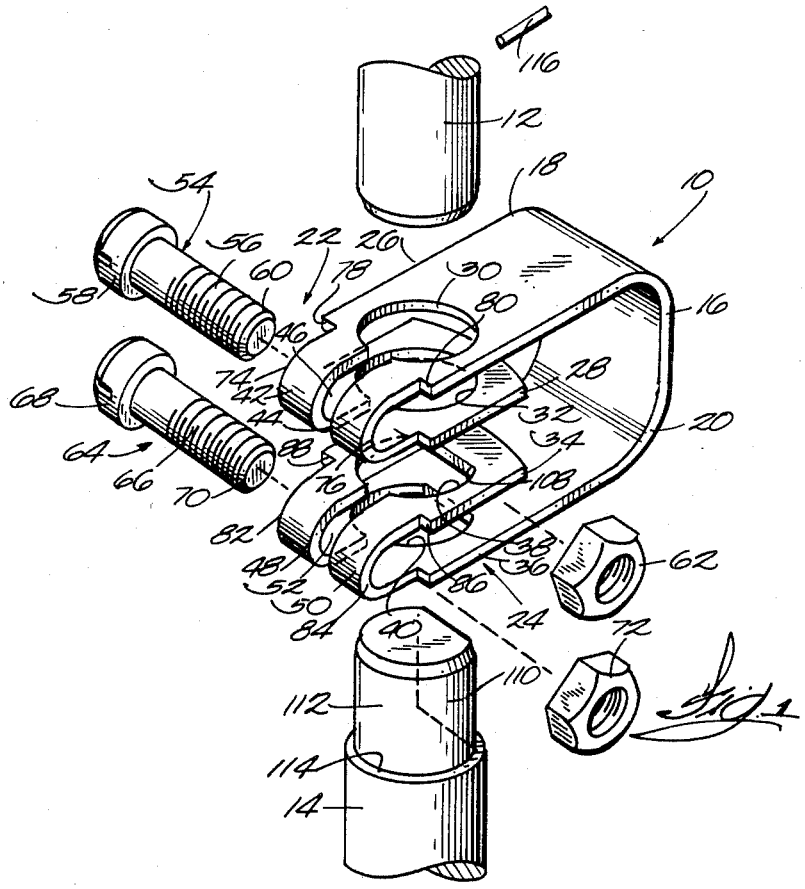
FIG. 1 is an exploded perspective view of a flexible coupling which is included in a fuel supply assembly which embodies various of the features of the invention.

Illustrated in FIGS. 1 and 2, is a fuel supply assembly, generally designated 4, comprising carburetors 6 and 8, and a generally U-shaped flexible coupling, generally designated 10, for connecting a pair of rotable members or shafts, such as a pair of separate carburetor throttle shafts 12 and 14, which may be axially offset or out of alignment. The coupling 10 includes a bight 16 connected to a pair of legs 18 and 20 each having a free end including a generally U-shaped member. The U-shaped members are generally designated 22 and 24. The U-shaped member 22 includes a pair of arms 26 and 28 with apertures 30 and 32 for receiving the carburetor throttle shaft 12 as best illustrated in FIG. 2. The U-shaped member 24 also includes a pair of arms 34 and 36 having apertures 38 and 40 for receiving the throttle shaft 14, as will be described further below.

As illustrated in FIG. 1, the U-shaped member 22 includes an arcuate bight having arcuate side portions 42 and 44 separated by a centrally located slot 46 communicating with the arm apertures 30 and 32. Similarly, the U-shaped member 24 includes an arcuate bight with arcuate side portions 48 and 50 separated by a centrally located slot 52 communicating with arm apertures 36 and 40.

Each of the U-shaped members also includes clamping means for squeezing the arcuate side portions of the arcuate bight together to reduce the opening size of the slot and arm apertures, whereby the pair of arms of each of the U-shaped members engages a separate one of the carburetor throttle shafts so that the pair of carburetor shafts, shafts 12 and 14 as shown, are flexibly coupled for common rotation.

More particularly, while various clamping means arrangements are possible, in the preferred embodiment illustrated, such clamping means for the U-shaped member 22 comprises a bolt generally designated 54 having a shaft 56 extending through said U-shaped member 22 generally traverse to the throttle shaft 12 and adjacent to the arcuate side portions 42 and 44 of the arcuate bight. The bolt 54 includes a head 58 at one end of the shaft 56 and a threaded portion 60 at the other end of the shaft. A nut 62 threadingly engages the threaded portion 60 of the bolt shaft 56 to squeeze together the arcuate side portions 42 and 44 to reduce the opening size of slot 46 and arm apertures 30 and 32, so that the U-shaped member 22 clamps or engages the carburetor throttle shaft 12. Similarly, the clamping means for the other U-shaped member 24 includes a bolt generally designated 64 having a shaft 66, with a head 68 and a threaded portion 70 which is threadingly engaged by nut 72.

In the preferred embodiment shown, each of the U-shaped members includes locking means for locking the nut against rotation when the bolt is threadingly engaged and tightened within the nut to squeeze the arcuate side portions together. In the preferred embodiment illustrated, such locking means of the U-shaped member 22 comprises said arcuate side portions 42 and 44 including opposite outer edges 74 and 76 recessed relative to the U-shaped member arms 26 and 28, to form two pairs of flanges, 78 and 80, which can lock the nut 62 against rotation when bolt 58 is engaged and tightened within the nut 62 to squeeze together the arcuate side portions. Similarly the other U-shaped member 24 also includes locking means which comprises the arcuate side portions 48 and 50 including opposite outer edges 82 and 84 recessed relative to the U-shaped member arms 34 and 36 to form two pairs of flanges 86 and 88.

As illustrated, the flanges are preferably formed to lock the nuts 62 and 72 against rotation and to allow the respective bolt heads 58 and 68 to be recessed relative to the U-shaped member arms when the bolts extend through the U-shaped members from either direction.

The U-shaped coupling 10, as shown in FIG. 2, is flexible in the plane shown. While various materials could be utilized, the coupling 10 is preferably made from strip steel stock. The coupling is relatively inexpensive, and is flexible to allow possible offset "B" in the axes of the carburetor throttle shafts, as shown in FIG. 2, and to allow for the possible offset "C", as shown in FIG. 3.

As illustrated, the flexible coupling 10 is used to link the separate carburetor throttle shafts 12 and 14 of the carburetors, generally designated 6 and 8, which are part of the fuel supply assembly, generally designated 4, as shown in FIG. 2. Carburetors 6 and 8, which can be of generally conventional construction and operation, are mounted on a manifold 94. The mounting surfaces on the manifold 94 or difference in thicknesses of gaskets 96 and 98 may cause the offset "B" shown in FIG. 2. The offset "C", as shown in FIG. 3, where the axes of rotation of the the throttle shafts 12 and 14 may be out of alignment, can result because of clearance in mounting holes 100 and 102 for carburetors 6 and 8 respectively.

In the case of carburetors, in order to have the throttle valves, 104 and 106, mounted on throttle shafts 12 and 14, respectively, open at exactly the same time, the coupling 10 is used to synchronize the opening of the throttle valves. More particularly, the apertures of arms 34 and 36 of the U-shaped member 24 includes a flat 108, which matches the flat 110 on an end portion 112 of the throttle shaft 14, thereby preventing rotational displacement of the throttle shaft 14 relative to the coupling 10, and controlling the arc which the coupling 10 travels as the throttle shaft 14 rotates. When the coupling 10 is used to synchronize the throttle valves 104 and 106, the lower bolt 64 as shown in FIG. 1, is tightened first so that the U-shaped member 24 engages the carburetor throttle shaft 14. At that point, both carburetor throttle valves 104 and 106 are manually closed and the bolt 54 extending through the U-shaped member 22 is tightened to engage the carburetor throttle shaft 12.

The coupling 10 is preferably installed under compression so that if there is axial displacement and separation of the throttle shafts, the coupling can expand so that the shafts remain fully engaged within the U-shaped members 22 and 24 of the coupling. If the carburetors 6 and 8 are placed over bolts (not shown) extending from the manifold 94, the coupling must be installed over the throttle shafts, and the carburetors are then installed together over the bolts. If the carburetors are mounted by screws (not shown) extending into the manifold 94, the coupling can be placed over the shaft of one of the carburetors, and the second carburetor throttle shaft can be slid into the coupling after installation of the first carburetor.

Since the coupling 10 is preferably installed under compression, means to prevent the U-shaped members from expanding outwardly over the throttle shafts after installation, are preferably provided. In the illustrated preferred embodiment, such means comprises the throttle shaft 14 having a shoulder 114 formed between the junction of portion 112 including the flat 110, and the remainder of the throttle shaft 14. The shoulder 114 precludes travel of U-shaped member 24 over shaft 14. Such means also includes a pin 116 extending transversely through throttle shaft 12, so that the U-shaped member 22 bears against pin 116 and does not travel further over shaft 12. Thus coupling 10 is installed under compression to flexibly couple the carburetor throttle shafts for common rotation.

Various of the features of the invention are set forth in the following claims.

We claim:

1. A fuel supply assembly comprising a first carburetor having a throttle shaft, and a second carburetor having a separate throttle shaft, said pair of carburetor throttle shafts having axes of rotation in general alignment, and a generally U-shaped coupling for flexibly connecting said pair of separate carburetor throttle shafts so as to accomodate said shafts being axially offset or out of alignment, said coupling including a bight connected to a pair of legs each having a free end including a generally U-shaped member having a pair of arms with apertures for receiving one of said carburetor throttle shafts, each of said U-shaped members also including an arcuate bight having arcuate side portions separated by a centrally located slot communicating with said arm apertures, and also including clamping means for squeezing together said arcuate side portions of said arcuate bight to reduce the opening size of said slot and arm apertures, whereby said pair of arms of each of said U-shaped members engages a separate one of said carburetor throttle shafts so that said pair of carburetor throttle shafts are flexibly coupled for common rotation.

2. A fuel supply assembly in accordance with claim 1 wherein said clamping means for each of said U-shaped members comprises a bolt extending through said U-shaped member, generally transverse to said throttle shaft, and adjacent to said arcuate side portions of said arcuate bight, said bolt including, at one end thereof, a head, and at the other end thereof, a threaded portion, said clamping means also including a nut which threadingly engages said threaded portion to squeeze together said arcuate side portions to reduce the opening size of said slot and arm apertures.

3. A fuel supply assembly in accordance with claim 2 wherein each of said U-shaped members includes locking means for locking said nut against rotation when said bolt is threadingly engaged and tightened within said nut to squeeze together said arcuate side portions.

4. A fuel supply assembly in accordance with claim 3 wherein said locking means for each of said U-shaped members comprises said arcuate side portions of said arcuate bight including opposite outer edges, with at least one of said outer edges recessed relative to said U-shaped member arms to form a pair of flanges which lock said nut against rotation when said bolt is threadingly engaged and tightened within said nut to squeeze together said arcuate side portions.

5. A fuel supply assembly in accordance with claim 4 wherein said locking means for each of such U-shaped members comprises said opposite outer edges of both of said arcuate side portions being recessed relative to said U-shaped member arms so that two pair of flanges are formed to lock said nut against rotation and to allow said bolt head to be recessed relative to said arms when said bolt extends through said U-shaped member from either direction, with said nut threadingly engaged and tightened to squeeze together said arcuate side portions.

6. A fuel supply assembly in accordance wth claim 1 wherein one of said throttle shafts includes an end with a flat which extends through said aperture in one of a pair of arms of one of said U-shaped members, and wherein said arm includes a matching flat extending into said aperture, thereby preventing rotational displacement of said one throttle shaft relative to said coupling, and controlling the arc which said coupling travels through as said one throttle shaft rotates.

7. A fuel supply assembly in accordance with claim 6 wherein said one of said throttle shafts and the other one of said throttle shafts each includes a throttle valve mounted thereon, and wherein the other one of said U-shaped members includes a pair of arms with generally circular apertures allowing for relative rotation between said coupling and said other one of said throttle shafts during installation, whereby said coupling can be used to synchronize the rotational position of said throttle valves mounted on said throttle shafts.

8. A fuel supply assembly in accordance with claim 1 wherein said coupling is preferably installed under compression with said U-shaped members biased toward each other so that if there is axial displacement and separation of said throttle shafts, the coupling can expand so that the throttle shafts remain fully engaged within said U-shaped members of said coupling.

9. A fuel supply assembly in accordance with claim 8 wherein each of said carburetor throttle shafts includes stop means to prevent said U-shaped members from expanding axially over said throttle shafts while installed under compression.

10. A fuel supply assembly in accordance with claim 9 wherein said stop means comprises one of said throttle shafts having a shoulder, and the other one of said throttle shafts having a pin extending transversely therethrough.

11. A generally U-shaped flexible coupling for connecting a pair of separate carburetor throttle shafts which may be axially offset or out of alignment, said coupling comprising a bight connected to a pair of legs each having a free end including a generally U-shaped member having a pair of arms with apertures for receiving one of the carburetor throttle shafts, each of said U-shaped members also including an arcuate bight having arcuate side portions separated by a centrally located slot communicating with said arm apertures, and also including clamping means for squeezing together said arcuate side portions of said arcuate bight to reduce the opening size of said slot and arm apertures, whereby said pair of arms of each of said U-shaped members engages a separate one of the carburetor throttle shafts so that the pair of carburetor throttle shafts are flexibly coupled for common rotation.

12. A flexible coupling in accordance with claim 11 wherein said clamping means for each of said U-shaped members comprises a bolt extending through said U-shaped member, generally transverse to the throttle shaft, and adjacent to said arcuate side portions of said arcuate bight, said bolt including, at one end thereof, a head and, at the other end thereof, a threaded portion, said clamping means also including a nut which threadingly engages said threaded portion to squeeze together said arcuate side portions to reduce the opening size of said slot and arm apertures.

13. A flexible coupling in accordance with claim 12 wherein each of said U-shaped members includes locking means for locking said nut against rotation when said bolt is threadingly engaged and tightened within said nut to squeeze together said arcuate side portions.

14. A flexible coupling in accordance with claim 13 wherein said locking means for each of said U-shaped members comprises said arcuate side portions of said arcuate bite including opposite outer edges, with at least one of said outer edges recessed relative to said U-shaped member arms to form a pair of flanges which lock said nut against rotation when said bolt is threadingly engaged and tightened within said nut to squeeze together said arcuate side portions.

15. A flexible coupling in accordance with claim 14 wherein said locking means for each of said U-shaped members comprises said opposite outer edges of both of said arcuate side portions being recessed relative to said U-shaped member arms so that two pair of flanges are formed to lock said nut against rotation and to allow said bolt head to be recessed relative to said arms when said bolt extends through said U-shaped member from either direction, with said nut threadingly engaged and tightened to squeeze together said arcuate side portions.

16. A flexible coupling in accordance with claim 11 wherein one of the throttle shafts includes an end with a flat which extends through said aperture in one of a pair of arms of one of said U-shaped members, and wherein said one arm includes a matching flat extending into said aperture, thereby preventing rotational displacement of the one throttle shaft relative to said coupling, and controlling the arc which said coupling travels through as said one throttle shaft rotates.

17. A flexible coupling in accordance with claim 16 wherein said one of the throttle shafts and the other one of the throttle shafts each includes a throttle valve mounted thereon, and wherein the other one of said U-shaped members includes a pair of arms with generally circular apretures allowing for relative rotation between said coupling and said other one of the throttle shafts during installation, whereby said coupling can be used to synchronize the rotational position of the throttle valves mounted on the throttle shafts.

18. A flexible coupling in accordance with claim 11 wherein said coupling is preferably installed under compression with said U-shaped members biased toward each other so that if there is axial displacement and separation of the throttle shafts, the coupling can expand so that the throttle shafts remain fully engaged within said U-shaped members of said coupling.

19. A generally U-shaped flexible coupling for flexibly connecting a pair of rotable members having generally aligned axes of rotation, said coupling comprising a bight connected to a pair of legs each having a free end including a generally U-shaped member having a pair of arms with apertures for receiving one of the rotable members, each of said U-shaped members also including an arcuate bight having arcuate side portions separated by a centrally located slot communicating with said arm apertures, and also including clamping means for squeezing together said arcuate side portions of said arcuate bight to reduce the opening size of said slot and arm apertures, whereby said pair of arms of each of said U-shaped members engages a separate one of the rotable members so that the pair of rotable members are flexibly coupled for common rotation.

20. A flexible coupling in accordance with claim 19 wherein said clamping means for each of said U-shaped members comprises a bolt extending through said U-shaped member, generally transverse to the rotatable member and adjacent to said arcuate side portions of said arcuate bight, said bolt including, at one end thereof, a head, and at the other end thereof, a threaded portion, said clamping means also including a nut which threadingly engages said threaded portion to squeeze together said arcuate side portions to reduce the opening size of said slot and arm apertures.

21. A flexible coupling in accordance with claim 20 wherein each of said U-shaped members includes locking means for locking said nut against rotation when said bolt is threadingly engaged and tightened within said nut to squeeze together said arcuate side portions.

22. A flexible coupling in accordance with claim 21 wherein said locking means for each of said U-shaped members comprises said arcuate side portions of said arcuate bight including opposite outer edges, with at least one of said outer edges recessed relative to said U-shaped member arms to form a pair of flanges which lock said nut against rotation when said bolt is threadingly engaged and tightened within said nut to squeeze together said arcuate side portions.

23. A flexible coupling in accordance with claim 22 wherein locking means for each of such U-shaped members comprises said opposite outer edges of both of said arcuate side portions being recessed relative to said U-shaped member arms so that two pair of flanges are formed to lock said nut against rotation and to allow said bolt head to be recessed relative to said arms when said bolt extends through said U-shaped member from either direction, with said nut threadingly engaged and tightened to squeeze together said arcuate side portions.

24. A flexible coupling in accordance with claim 19 wherein one of the rotatable members includes an end with a flat which extends through said aperture in one of a pair of arms of one of said U-shaped members, and wherein said one arm includes a matching flat extending into said aperture, thereby preventing rotational displacement of said one rotatable member relative to said coupling, and controlling the arc which said coupling travels through as said one rotatable member rotates.

25. A flexible coupling in accordance with claim 24 wherein said one of the rotatable members and the other one of the rotatable members each includes a control device mounted thereon, and wherein the other one of said U-shaped members includes a pair of arms with generally circular apertures allowing for relative rotation between said coupling and said other one of the rotatable members during installation, whereby said coupling can be used to synchronize the rotational position of the control devices mounted on the rotable members.

26. A flexible coupling in accordance with claim 19 wherein said coupling is preferably installed under compression with said U-shaped members biased toward each other so that if there is axial displacement and separation of the rotatable members, the coupling can expand so that the rotatable members remain fully engaged within said U-shaped members of said coupling.

* * * * *